United States Patent [19]

Byerley

[11] Patent Number: 4,527,504

[45] Date of Patent: Jul. 9, 1985

[54] SAFETY DEVICE TO QUICKLY LOCATE A DROWNING VICTIM

[76] Inventor: Arlie Byerley, 4010 Joliet Rd., Lyons, Ill. 60534

[21] Appl. No.: 426,986

[22] Filed: Sep. 29, 1982

Related U.S. Application Data

[63] Continuation-in-part of Ser. No. 211,075, Nov. 28, 1980, abandoned.

[51] Int. Cl.[3] ..... G08B 1/00

[52] U.S. Cl. ..... 116/211; 116/209

[58] Field of Search ..... 116/209–211; 441/6–8, 11

[56] References Cited

U.S. PATENT DOCUMENTS

| | | | |
|---|---|---|---|
| 2,464,834 | 3/1949 | Taylor | 73/170 A |
| 2,646,019 | 7/1953 | Chetlan | 116/210 |
| 2,675,776 | 4/1954 | Tuve | 116/211 |
| 2,941,217 | 6/1960 | Hartl | 441/8 |
| 2,968,819 | 1/1961 | Jenson | 116/209 |
| 3,121,889 | 2/1964 | Gentile | 441/6 |
| 3,156,933 | 11/1964 | Brooks | 116/211 |
| 3,334,364 | 8/1967 | Foss et al. | 441/8 |

*Primary Examiner*—Charles Frankfort
*Assistant Examiner*—W. Morris Worth
*Attorney, Agent, or Firm*—John H. Shurtleff

[57] ABSTRACT

Safety device for quickly locating a drowning victim underwater which essentially includes a hollow cap member open at one end, a threaded spool inside the cap member and containing a water-soluble marking dye, a solid, water-soluble closure member which fits over the cap open end and is adhered to the cap member and may also be adhered to one end of the spool, and a safety pin or similar member to attach the device to a potential drowning victim, the free end of the thread extending outwardly from the cap member with its free end tied to the safety pin or other attaching member which in turn is joined to one of said cap and closure members.

12 Claims, 4 Drawing Figures

SAFETY DEVICE TO QUICKLY LOCATE A DROWNING VICTIM

This is a continuation-in-part of application Ser. No. 211,075, filed Nov. 28, 1980, now abandoned.

BACKGROUND OF THE INVENTION

This invention concerns a safety device in the form of a "drowning pin" for quickly locating a drowning victim underwater who must be pulled out and given immediate first aid and medical care. More particularly, the invention is concerned with a safety device which will be self-actuating and which can be easily assembled from readily obtainable and inexpensive components.

It is well known that many persons drown every year, especially children who are subject to accidentally falling into relatively deep water where they cannot be located quickly enough to be rescued and revived. Accidental drownings often occur during family picnics or similar outings near a body of water such as a lake, pond or river, where young children who are poor or inexperienced swimmers fall into the water and suddenly disappear without any visible trace. Even experienced swimmers who are fishermen or boating enthusiasts may fall overboard and be subjected to the sudden shock of cold water causing unconsciousness so that they cannot swim but instead sink down into the water. Workers on bridges or waterfront structures may be injured or knocked unconscious just before falling into the water so as to be unable to save themselves.

These unfortunate circumstances arise all to frequently, and although the best safety precaution is to wear a buoyant safety vest or the like, such garments are relatively expensive and interfere with normal activities so that many persons will not wear them. A few safety devices have been proposed for use by swimmers or bathers where a buoy is releasably attached to a holder worn on the body of the person in the water, the buoy preferably being released by the victim when in fear of drowning. Two such devices were disclosed almost 50 years ago by Neal, U.S. Pat. No. 1,935,229 (1933) and Carlbeck, U.S. Pat. No. 1,955,053 (1934), but require relatively complex and expensive structures making it difficult to encourage their purchase and use. Moreover, these devices do not offer a dye marker or any means of accomodating a dye marker, probably because the devices are intended to be worn during normal bathing or swimming when they are immersed in the water.

Dye markers have been used in conjunction with life jackets as shown by Collyer et al, U.S. Pat. No. 2,418,397 (1947) and Bender, U.S. Pat. No. 2,418,392 (1947), but these dye markers require the person wearing the life jacket to release the dye after being in the water. No simple device is offered which will automatically release or give off a dye marker together with the actuation of a buoy or other flotation member, i.e. without requiring some conscious act on the part of the drowning victim.

It is a principal object of the present invention to provide a simple, inexpensive and unobtrusive safety device which can be readily attached to a potential drowning victim, including small children, preferably to a garment worn by such a person, wherein the device is normally worn outside of the water and is actuated automatically in the event the wearer falls or jumps into the water. The device is to be made from readily available parts and so inexpensive that any person will find it affordable and readily useable and even reusable. Due to its small size and lightness in weight, the device can be pinned or otherwise affixed to a shirt, coat collar, sleeve, wrist band, waist band or the like where it will not interfere with a person's normal activities.

The device of the invention which achieves these objects is made to include a hollow cap member open at one end, a spool composed of a low density material floatable in water, the spool being placed within the cap member, a thread wound on said spool with the free end of the thread extending outwardly from the open end of the cap member, a solid but highly water-soluble closure member fitting over the open end of the cap member and being tightly adhered thereto, a water-soluble marking dye for discoloring water contained on or within the spool member, and means to attach the device to a potential drowning victim, the free end of the thread being tied to said attaching means which in turn is joined to one of said cap and closure members.

The body of the spool preferably consists essentially of a pourous and closed cell, expanded polystyrene, and the thread is preferably selected as a high test, monofilament nylon line. The closure member, which must be very soluble in water, can be in the form of a common sodium bicarbonate tablet. The water-soluble dye can be used in a number of different forms such as a powder, pill or capsule, all readily available as commercial products, to be inserted within a hollow core or axial bore of the spool or else adhered to one end of the spool.

Other objects and advantages of the invention as well as especially preferred embodiments of the safety device are set forth by way of example in the following detailed description, limited only by the scope of the appended claims.

THE DRAWINGS

DESCRIPTION OF THE PREFERRED EMBODIMENTS

Figure 1:
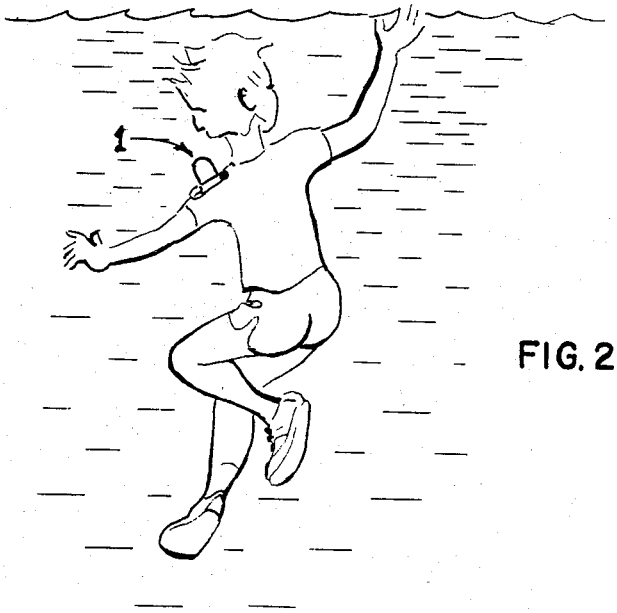
FIG. 1 is a pictorial view of the safety device of the invention pinned on the shirt shoulder of a child who has fallen in the water and is unable to swim or to take other positive steps to obtain help.
Figure 2:
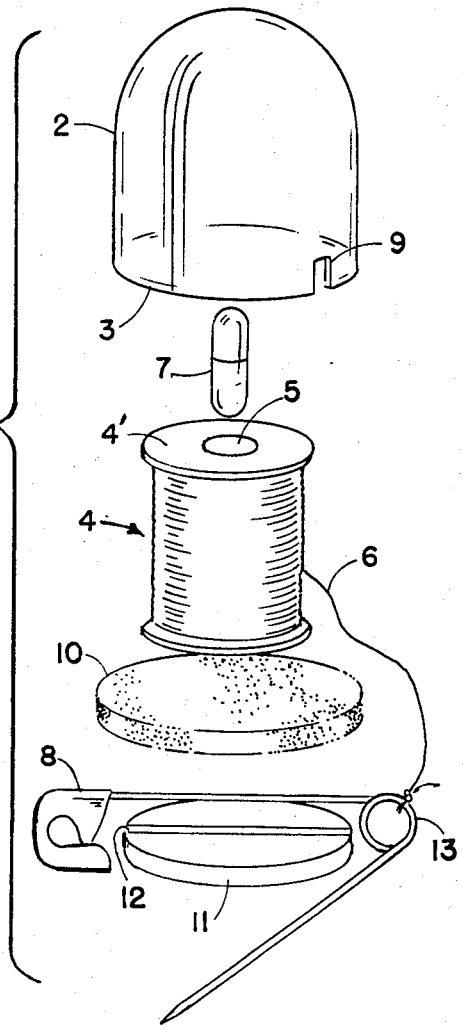
FIG. 2 is an enlarged and exploded perspective view of one embodiment of the safety device of the invention to illustrate the individual components.
Figure 3:
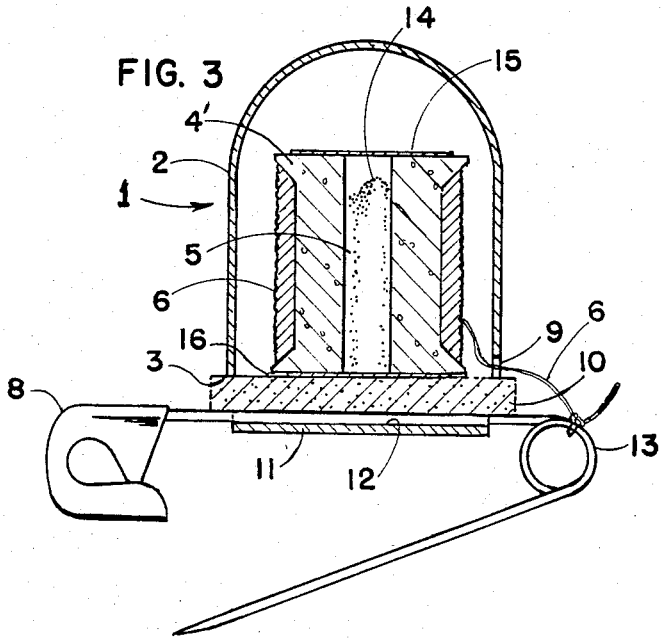
FIG. 3 is an enlarged cross sectional view of another embodiment of the invention taken through the axis of the spool as centered within a cap member.

Referring first to FIGS. 1–3, the safety device 1 is generally shown in larger than actual size for ease of illustration, including FIG. 1 where it is pinned to the shirt shoulder of a drowning child submerged below the level of the water with the cap 2 still intact. The child may be unconscious or too frightened to be able to actuate a safety device or to even keep above the surface of the water. In many cases, a non-swimmer falls into the water and sinks directly to the bottom without a trace.

The structure and assembly of one desirable embodiment of the safety device 1 is shown in the exploded view of FIG. 2. In this case, the device makes use of a transparent bubble cap 2 having a hemispherical upper section and a cylindrical lower section where it is open at its lower end as defined by the circular edge or rim 3. The threaded spool 4 with its exposed ends 4 and an axial bore 5 is adapted to fit completely within the cap 2 except for the free end of the thread 6 which extends at least a short distance outwardly and below the open end or rim 3 of the bubble cap.

A small dye capsule 7 is adapted to be friction fitted into the axial bore 5 of the spool, both the outer protective capsule and the dye inside being water-soluble so as to quickly mark the location of the drowning person. In using a dye capsule, it is preferable to use a powder or small encapsulated beads of the dye. Since the capsule 7 is fixed inside the bore 5 of the threaded spool 4, the lower half can be made of a water-insoluble material while the upper half is water-soluble. This helps to delay the dissolution of the dye as the floatable spool rises to the surface.

The spool 4 is a one-piece body made of an expanded polystyrene such as Styrofoam ® or a similar commercial thermoplastic polymer as now commonly used for most thread spools. Foamed polyurethane or poly(ester-urethane) materials can be molded as spools. Wooden spools may also be used as well as any material of sufficiently low density to float the spool up toward the surface of the water.

In principle, any strong thread or cord could be used as the payout line which remains tied at its free end 6 to the safety pin 8 which in turn is attached to the garment of the drowning person. However, very high strength monofilament nylon threads are readily available, and are especially suitable for purposes of the present invention. The line 6 is not intended as a means of pulling up the drowning person but rather as a locating means which can be followed down to the person underwater from the floating spool. The cap 2 preferably has a small notch or slot opening 9 at its bottom edge 3 so that the thread end 6 runs freely from inside the cap for connection to the spring eye 13 at one end of the safety pin 8.

The closure member 10 is preferably a sodium bicarbonate tablet such as an Alka-Seltzer ® tablet which can be made or purchased at very low cost. Other readily soluble salts or materials may also be used, but a carbonate or bicarbonate is especially useful since this type of compound dissolves with the release of carbon dioxide and the resulting gas bubbles assist the dissolution and dispersion of the dye from the spool.

In the assembly of the device, the threaded spool 4 is preferably glued to the closure member or tablet 10, and the bubble cap 2 is then placed over this spool and glued at its free end 3 to the tablet 10. It is preferable to use as the glue one of the well-known, highly reactive and quick setting polyurethane and isocyante-based adhesives sold under a variety of brand names. Such adhesives are water-insoluble and bond readily to wood, metals, plastics, paper and other substances and possess relatively high strength.

The safety pin 8 may be glued in the same manner to the underside of the water-soluble tablet or disc 10, but it is preferable to use the plate member 11 with slot 12 to receive the upper arm or rod of the safety pin, with a glue point between the facing surfaces of the tablet 10 and the plate 11. Then, even if the pin 8 works loose from tablet 10, it will be held in place by the plate 11. The plate 11 may be made of a stiff cardboard, wood or plastic material, e.g. either cut or molded to shape.

In general, it is preferable to use the above-described water-insoluble glue in order to quickly and easily assemble the components of the safety device 2 for immediate packaging or use. Moreover, only a very thin coating of glue is needed between the opposing surfaces of the rim 3, bottom face of spool 4, plate 11 and the water-soluble tablet 10. In those embodiments where the bubble cap 2 is saved or recovered, it is a relatively simple task for anyone to replace a used, broken or missing sodium bicarbonate tablet 10 and also to add or replace the dye in or on the spool 4.

In FIG. 3, a slightly different embodiment is shown wherein the dye 14 is introduced as a powder or granulate into the axial bore 5 of the spool 4. In this case, the open ends of the bore 5 are preferably closed by a paper-like sealing member 15 and 16, respectively, at least one of which is at least permeable if not soluble for the water and dye. The powdered dye 14 can then escape at one or both ends of the spool 4, the rate of flow of the dye being more accurately controlled based upon the solubility or permeability of one or both of the sealing members 15 and 16. In this particular embodiment, the sealing members 15 and 16 can also be readily glued in place, but at least one of these two members must be free of adhesive in the circular area covering the axial bore 5 in order to permit the dye to escape from the spool.

Figure 4:
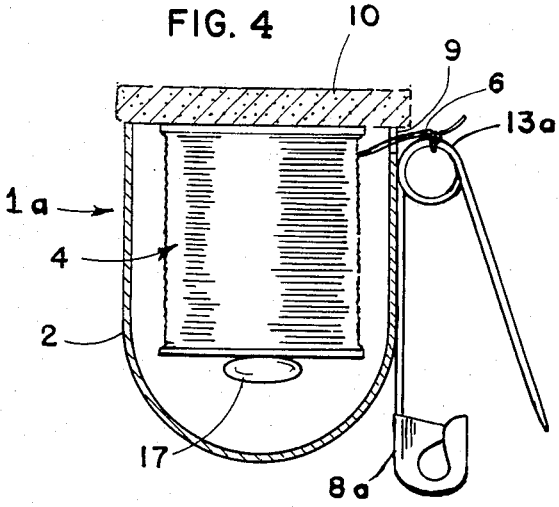
FIG. 4 is an enlarged cross sectional view through the cap and spool axis of an especially preferred embodiment of the invention.

An especially preferred embodiment of the invention is illustrated in FIG. 4 wherein the safety device **1*a* requires only five essential components, namely the bubble cap 2, the threaded spool 4, the soluble tablet 10 as a closure member, a safety pin 8*a* with the free end of the thread 6 tied to spring eye 13*a* of the safety pin, and a solid dye pill 17 glued to the lower end of the spool which preferably has its upper end glued to tablet 10, using the same glues mentioned above. The assembly of this safety device 1*a* is substantially the same as the embodiments of FIGS. 2 and 3, although it is never essential to always glue one spool end to the tablet 10. This device 1*a* of FIG. 4 is adapted to be pinned on the garment of a person in the position shown, i.e. with the tablet 10 on top and the open end of the cap 2 facing upwardly when the person is approximately upright in the water. The principle advantage of this embodiment, however, resides in the connection of the pin 8*a* by gluing, welding or soldering it directly to the side of the bubble cap 2** which here is preferably a lightweight metal cap capable of being used over and over again.

The hemispherical section of the bubble cap 2 in all embodiments can be partly filled with a lightweight padding such as cotton or the like to keep the threaded spool 4 from shifting or moving about within this cap. These and similar modifications will be readily suggested to any person familiar with this art.

The combination of the bubble cap 2 with the water-soluble but solid closure member 10 has the further advantage that the enclosed space adds to the initial buouancy of the device so that there is a stronger tendency for the spool 4 to be released even before the tablet 10 has completely dissolved. In fact, the release of the spool 4 will normally occur within a very short period of time after being submerged in water, e.g. within only a few seconds up to about 10–15 seconds. This permits the spool to escape almost immediately and to begin spreading dye a very short time after the drowning person has disappeared below the surface of the water or even during an initial struggle to stay afloat near the surface of the water.

The buoyant spool 4' will freely unwind while the free end 6 of the thread is attached by the safety pin and to the drowning person. The notch or slot 9 in the cap 2 is placed so that the cap does not interfere with the unwinding thread even if this cap 2 remains attached to the person as in the special embodiment of FIG. 4. Also, there is little or no danger of inadvertantly gluing the thread to the cap 2 when the device is assembled.

The innermost end of thread 6 is preferably permanently fixed or tied to the spool 4' so that the spool remains on the thread even if all of the line pays out. The length of the line generally may be up to about 200 feet or about 65 yards, and for most bodies of water, even 60 feet of line or less is quite sufficient.

Because the safety device of the invention is so easily assembled from common and inexpensive materaials, it can be very advantageously packaged in kit form. A purchaser of the kit can put together one, two or more devices as needed for a specific location and specific persons. Such kits permit an even further reduction in cost so that these safety devices can be supplied at a very modest cost as part of a highly needed safety program. By teaching an assembly of the device, there is a greater motivation to follow good safety practices and to take the needed precautions to avoid accidental drownings. And if such devices are regularly used, the number of actual drownings can be reduced due to the rapid recovery and treatment of persons wearing this kind of device.

I claim:

1. A safety device for quickly locating a drowning victim which comprises:

a hollow cap member open at one end;

a spool composed of a low density material floatable in water, said spool being releasably placed within said cap member;

a thread wound on said spool with the free end of the thread extending outwardly so as to pass freely from the open end of said cap member;

a solid but very water-soluble closure member fitting over the open end of said cap member and being tightly adhered thereto, said cap member having a small opening adjacent its open end for the outward passage of the free end of the thread clear of said closure member;

a water-soluble marking dye for discoloring water contained on or within said spool member; and means to attach said device to a potential drowning victim, the free end of said thread being tied to said attaching means which in turn is joined to one of said cap and closure members.

2. A safety device as claimed in claim 1 wherein said attaching means is a safety pin.

3. A safety device as claimed in claim 2 wherein the safety pin is joined to said cap member.

4. A safety device as claimed in claim 2 wherein the safety pin is joined to the closure member by means of a sealing plate pressed over one arm of the pin and adhered to said closure member.

5. A safety device as claimed in claim 1 wherein said spool has a body consisting essentially of a porous, closed cell, expanded polystyrene.

6. A safety device as claimed in claim 1 wherein said spool has an axial bore extending therethrough, and the water-soluble dye is placed in said axial bore.

7. A safety device as claimed in claim 1 wherein a solid, water-soluble dye tablet is adhered to one end of said spool.

8. A safety device as claimed in claim 3 wherein a solid, water-soluble dye tablet is adhered to one end of said spool.

9. A safety device as claimed in claim 6 wherein a water-soluble dye in powdered form is filled into said axial bore whose ends are closed by a paper-like sealing member, at least one sealing member being at least water- and dye-permeable.

10. A safety device as claimed in claim 8 wherein said spool has a body consisting essentially of a porous, closed cell, expanded polystyrene.

11. A safety device as claimed in claim 10 wherein said closure member is a circular sodium bicarbonate tablet.

12. A safety device as claimed in claim 1 wherein said thread is a nylon monofilament.

* * * * *